US009482227B2

(12) United States Patent
Stachowiak, Jr.

(10) Patent No.: US 9,482,227 B2
(45) Date of Patent: Nov. 1, 2016

(54) WIPER ASSEMBLY FOR A PUMP

(71) Applicant: Weatherford Technology Holdings, LLC, Houston, TX (US)

(72) Inventor: John Edward Stachowiak, Jr., Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 297 days.

(21) Appl. No.: 13/850,143

(22) Filed: Mar. 25, 2013

(65) Prior Publication Data

US 2013/0259647 A1 Oct. 3, 2013

Related U.S. Application Data

(60) Provisional application No. 61/616,776, filed on Mar. 28, 2012.

(51) Int. Cl.

| | |
|---|---|
| ***F04C 13/00*** | (2006.01) |
| ***F04C 14/28*** | (2006.01) |
| ***E21B 17/10*** | (2006.01) |
| *E21B 33/08* | (2006.01) |
| *F04C 2/107* | (2006.01) |

(52) U.S. Cl.

CPC ..... *F04C 13/005* (2013.01); *E21B 17/1071* (2013.01); *F04C 13/008* (2013.01); *F04C 14/28* (2013.01); *E21B 33/08* (2013.01); *F04C 2/1071* (2013.01)

(58) Field of Classification Search

CPC ..... E21B 17/006; E21B 17/1042; E21B 17/1071; E21B 33/128; E21B 33/08; E21B 43/38; F04C 13/005; F04B 47/005

USPC ..... 277/589

See application file for complete search history.

(56) References Cited

U.S. PATENT DOCUMENTS

| | | | | |
|---|---|---|---|---|
| 1,586,364 | A * | 5/1926 | Hendrickson | 277/329 |
| 1,594,935 | A * | 8/1926 | Wilmington | 277/329 |
| 1,904,631 | A * | 4/1933 | Roye | 277/329 |
| 1,930,982 | A * | 10/1933 | Norris | 277/329 |
| 2,966,121 | A | 12/1960 | Crowl | |
| 4,049,365 | A * | 9/1977 | Sparks, Sr. | 417/554 |
| 5,050,895 | A * | 9/1991 | Hashish | F16J 15/56 277/584 |
| 5,277,073 | A * | 1/1994 | Ruiz | G01N 30/20 277/589 |
| 6,145,590 | A | 11/2000 | Havard | |
| 7,686,598 | B2 | 3/2010 | Williams | |

OTHER PUBLICATIONS

United Kingdom Search Report dated Aug. 14, 2013, Application No. GB 1305474.7.

Canadian Office Action for Canadian Patent Applicaton No. 2,810,535, dated Jun. 23, 2014.

* cited by examiner

*Primary Examiner* — Nicole Coy

(74) *Attorney, Agent, or Firm* — Patterson & Sheridan, L.L.P.

(57) ABSTRACT

A wiper assembly may be used to prevent wellbore debris from entering an operating region of a pump. The wiper assembly may include a housing, a wiper member, a backing member, and a biasing member. The biasing member may bias the backing member into engagement with the wiper member, and thereby bias the wiper member into engagement with a tapered surface of the housing. The wiper member may include a corresponding tapered surface, which thereby forces the wiper member radially inward into engagement with an operating member of the pump.

17 Claims, 2 Drawing Sheets

17
FALLING SAND
14
15
21
20
10

3
4
5
6
7
1
9
2
8
12
9
11
18

10
13
3
16
4
19
5
6
7
8

WIPER ASSEMBLY FOR A PUMP

BACKGROUND OF THE INVENTION

1. Field of the Invention

Embodiments of the invention relate to a wiper assembly that prevents most or all debris, such as sand particles, from entering an operating region of a pump.

2. Description of the Related Art

To obtain fluids from an earth formation, a wellbore is drilled into the earth to intersect an area of interest within the formation. Upon reaching the area of interest within the formation, artificial lift means is often necessary to carry production fluid (e.g. hydrocarbon fluid) from the area of interest within the wellbore to the surface of the wellbore. Some artificially lifted wells are equipped with sucker rod lifting systems.

Sucker rod lifting systems generally include a surface drive unit, a sucker rod string, and a downhole positive displacement pump. The pump generally includes an outer barrel and an operating member, such as a plunger axially movable within the barrel to lift fluid to the surface. The sucker rod string generally comprises several rods connected together but may be one continuous rod, and is the primary link between the drive unit at the surface and the pump plunger. Reciprocating pumping action moves a traveling valve on the pump plunger, loading it on the down-stroke and lifting fluid to the surface on the up-stroke.

One problem associated with sucker rod lifting systems is wear within the annular region between the plunger and the barrel due to wellbore debris, such as sand. Since the annular region is typically about 0.002 inches to about 0.005 inches (per side), sand particles of various size enter the region and act as an abrasive, which quickly forms "grooves" in both the barrel and the plunger sliding surfaces. Such wear significantly diminishes the life of the barrel and the plunger, and can lead to costly repair and frequent maintenance.

Therefore, there is a need for an assembly to prevent debris from entering an operating region of a pump.

SUMMARY OF THE INVENTION

In one embodiment, a wiper assembly for a pump having an operating member may include a housing for receiving the operating member; and a wiper member disposed in the housing and forced into engagement with the operating member to prevent debris from entering into an operating region of the pump.

In one embodiment, a pump assembly may include a pump having an operating member axially movable within a housing; and a wiper assembly having a wiper member forced into engagement with the operating member to prevent debris from entering into the housing.

BRIEF DESCRIPTION OF THE DRAWINGS

So that the manner in which the above-recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figures 1A, 1B:
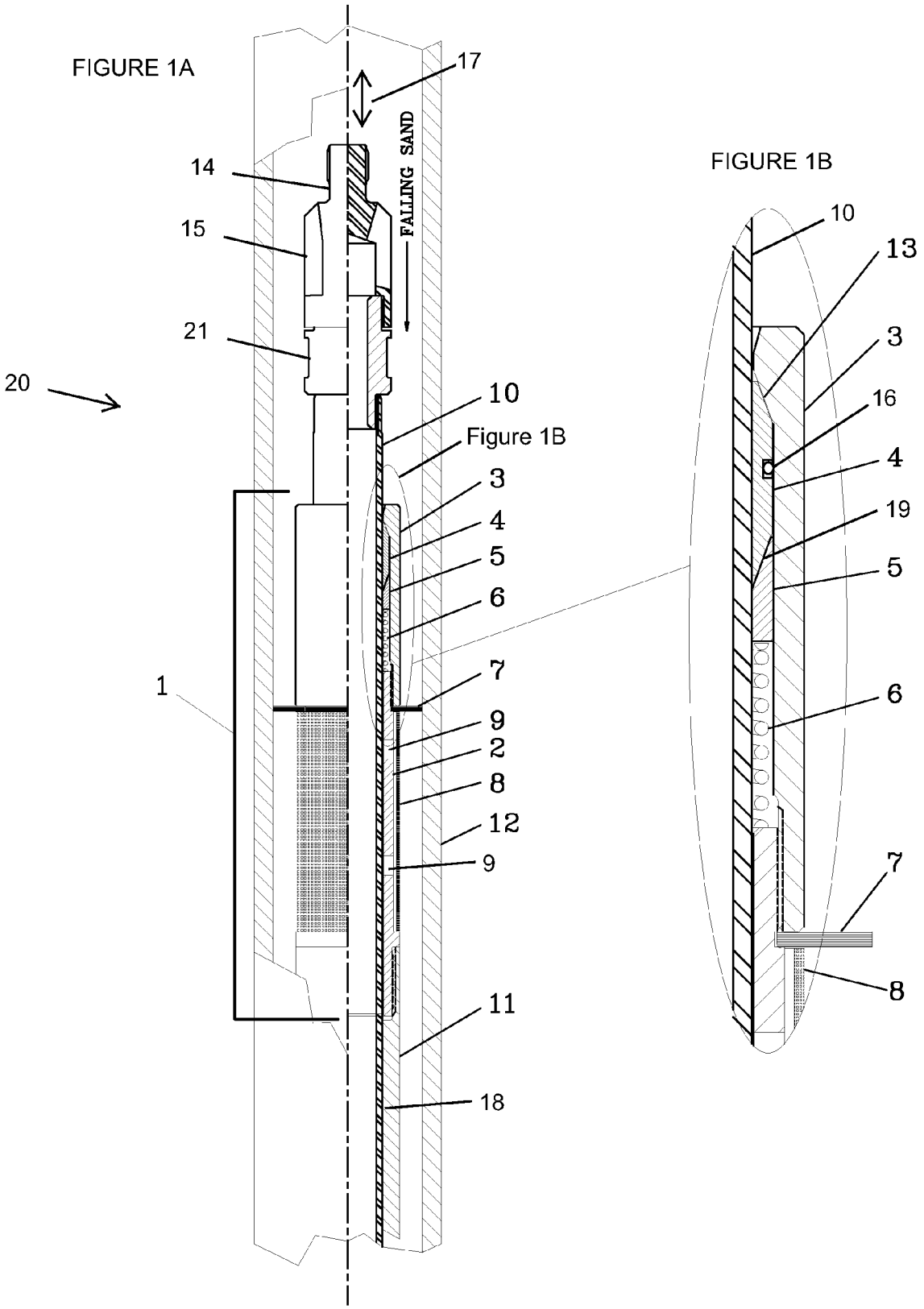
FIG. 1A illustrates a partial sectional view of a wiper assembly for a pump, according to one embodiment.
FIG. 1B illustrates an enlarged view of a section of the wiper assembly, according to one embodiment.

FIG. 1A illustrates a wiper assembly 1 for a pump 20. The pump 20 may be positioned in a casing or tubing string 12 of a wellbore for pumping fluid to the surface. The pump 20 includes a barrel 11, such as a mandrel or outer housing secured within the tubing string 12, and an operating member referred to herein as a plunger 10, such as a tubular or tubular string axially movable within and relative to the barrel 11 in an up and down direction as illustrated by reference arrow 17. A coupling member 21 couples the plunger 10 to a threaded connector 14, which connects the plunger 10 to a work string, such as a sucker rod string extending to the surface. The work string is driven at the surface by a motor or other surface drive unit to axially reciprocate the plunger 10 relative to the barrel 11 to lift fluid to the surface. When the plunger 10 is stroked in an upward direction, fluid in and above the pump 20 is lifted up through the wellbore (or tubing string 12) to the surface. When the plunger 10 is stroked in a downward direction, fluid may flow into the bore of the plunger 10 and out one or more openings 15 of the threaded connector 14 to be lifted to the surface.

The pump 20 may comprise a positive displacement pump, such as a plunger pump or sucker rod pump. Embodiments of the invention, however, may be used with other rod-type pumping systems. Although described herein as a downhole pump, embodiments of the invention may also be used with other conventional pumping-type systems, including surface and subsurface pumping applications. U.S. Pat. No. 6,883,612, entitled "Rod Pump," the contents of which are herein incorporated by reference in its entirety, describes the operation of a pump system (e.g. identified by reference numerals 100, 130) that may be used with the embodiments described herein. U.S. Pat. No. 7,905,294, entitled "Method of Anchoring a Progressive Cavity Pump," the contents of which are herein incorporated by reference in its entirety, describes the operation of one or more pumps (e.g. identified by reference numerals 100, 200, 400) that may be used with the embodiments described herein.

Referring to FIGS. 1A and 1B, the wiper assembly 1 may include a housing 3 for supporting a wiper member 4, a backing member 5, and a biasing member 6. The wiper assembly 1 is configured to prevent or substantially restrict wellbore debris, such as sand particles of a particular size, from entering an operating region 18 of the pump 20, which may cause significant wear and damage to the plunger 10 and/or barrel 11. The operating region 18 includes the area between the outer surface of the plunger 10 and the inner surface of the barrel 11.

The housing 3 may include an outer mandrel coupled to the barrel 11 (via an adapter 2 further described below) and having a bore through which the plunger 10 is axially movable. The housing 3 may also include a tapered surface for engaging an upper tapered surface of the wiper member 4, the tapered engagement identified as reference numeral 13. Similarly, the backing member 5 may include a tapered surface for engaging a lower tapered surface of the wiper member 4, the tapered engagement identified as reference numeral 19. The biasing member 6 biases the backing member 5 into engagement with the wiper member 4, which also forces the wiper member 4 into engagement with the tapered surface of the housing 3. The biasing member 6 may include a spring or other similar type of energizing member. In this manner, the tapered engaging surfaces 13, 19 force the wiper member 4 radially inward into engagement with the plunger 10 to prevent or substantially restrict wellbore debris from flowing past the wiper member 4 and into the operating region 18 of the pump 20 during operation.

In one embodiment, the wiper member 4 may be formed from a flexible or pliable material, such a plastic or Teflon. In one embodiment, the wiper member 4 may be in the form of a single, unitary ring and/or have a circular shape. In one embodiment, the wiper member 4 may be formed from two or more separate pieces of material.

In one embodiment, the backing member 5 may be formed from a metallic or rigid material, such as steel. In one embodiment, the backing member 5 may be in the form of a single, unitary ring and/or have a circular shape. In one embodiment, the backing member 5 may be formed from two or more separate pieces of material. In one embodiment, the backing member 5 does not completely extend around the outer circumference of the plunger 20.

In one embodiment, the biasing member 6 may act directly on the wiper member 4 without the need of a backing member 5. The biasing member 6 may bias the wiper member 4 into contact with the tapered surface of the housing 3 to force the wiper member 4 radially inward into engagement with the plunger 10. The biasing member 6 may act directly on a flat or non-tapered surface of the wiper member 4. In one embodiment, one or more biasing members 6 may be used with the wiper assembly 1.

In one embodiment, the arrangement of the wiper assembly 1 components may be provided in any order. For example, the backing member 5 and/or the biasing member 6 may be disposed above the wiper member 4 for biasing the wiper member 4 into engagement with a tapered shoulder on the inner diameter of the housing 3. The backing member 5 and/or the biasing member 6 may be disposed between an upper shoulder or surface of the housing 3 and the wiper member 4.

In one embodiment, the wiper assembly 1 includes only one of the tapered engagements 13 or 19 for operation. In one embodiment, the backing member 5 includes a flat or non-tapered upper surface that contacts a flat or non-tapered lower surface of the wiper member 4, such that the wiper member 4 is forced radially inward into contact with the plunger 10 by the tapered engagement 13 with the housing 3. In one embodiment, the wiper member 4 includes a flat or non-tapered upper surface that contacts a flat or non-tapered surface of the housing 3, such that the wiper member 4 is forced radially inward into contact with the plunger 10 by the tapered engagement 19 with the backing member 5.

In addition to or as an alternative to the biasing member 6 and/or the backing member 5, the wiper assembly 1 may include one or more biasing members 16 disposed through or on the outer diameter of the wiper member 4 and/or the inner diameter of the housing 3. The biasing member 16 may provide the similar energizing function of forcing the wiper member 4 into engagement with the plunger 10 during operation. The biasing member 16 may be arranged in other locations relative to the components of the wiper assembly 1 but operable to force the wiper member 4 into engagement with the plunger 10 during operation. The biasing member 16 may be an o-ring (or other similar type of elastomeric member), a spring, or other similar type of energizing member. In one embodiment, the biasing member 16 may be a seal that inherently forces the wiper member 4 into engagement with the plunger 10.

In addition to or as an alternative to the biasing members 6, 16 and/or the backing member 5, the wiper member 4 itself may be self-biased or self-energized into engagement with the plunger 10 to prevent debris from entering the operating region 18 of the pump 20. In one embodiment, the wiper member 4 may include a lip or other surface for forcing the wiper member 4 into contact with the plunger 10 when installed in the housing 3. In one embodiment, the wiper member 4 may have a reduced inner diameter relative to the outer diameter of the plunger 10. In one embodiment, the wiper member 4 may be forced into engagement with the plunger 10 simply by installation within the housing 3 and/or with one or more other components of the wiper assembly 1.

In one embodiment, one or more wiper members 4 may be used with the embodiments described herein. For example, the wiper assembly 1 may include a plurality of wiper members 4 disposed in the housing 3. Each of the wiper members 4 may be individually or jointly forced into engagement with the plunger 10 via one or more backing members 5 and/or biasing members 6, 16.

To prevent the wiper member 4 from forming a pressure-differential seal against the plunger 10, an adapter 2 having one or more fluid paths may be used. The adapter 2 may be connected to the lower end of the housing 3 and connected to the upper end of the barrel 11, such as by threaded connections. The plunger 10 is axially moveable within the housing 3 and the adapter 2. The adapter 2 is positioned below the wiper member 4, and in particular, may include a mandrel having one or more fluid paths or ports 9 disposed along its length to allow fluid slippage (e.g. a relatively small amount of fluid that escapes through the operating region 18 during normal pump operation). Fluid slippage may flow from the annular region surrounding the wiper assembly 1 into the ports 9 to thereby equalize fluid pressure on the wiper member 4.

In one embodiment, the adapter 2 may be formed integrally with the housing 3. In one embodiment, the adapter 2 and/or the housing 3 may be formed integrally with the barrel 11. In one embodiment, the biasing member 6 may be supported by at least one of the upper end of the adapter 2, the housing 3, and the barrel 11.

A first filter member 8, such as a screen, may be sealingly coupled to the adapter 2 for preventing or substantially restricting wellbore debris, such as sand particles of a particular size, from flowing into the ports 9 of the adapter 2 and into the operating region 18 of the pump 20. A second filter member 7 having a plurality of radially extending members, such as bristles of a wire brush, may engage the surrounding tubing string 12 wall and may be disposed above the first filter member 8. The second filter member 7 may prevent or substantially restrict falling wellbore debris from above, such as sand particles of a particular size, from flowing past the second filter member 7 and into the area adjacent the first filter member 8. The second filter member 7 may be supported by and/or disposed between the housing 3, the adapter 2, and/or the first filter member 8.

In operation, as the plunger 10 moves axially through the wiper assembly 1, the wiper member 4 bears against the outer surface of the plunger 10, blocking the entry path for wellbore debris from entering the operating region of the pump 20. The backing member 5 in conjunction with the biasing member 6 axially urges the wiper member 4 toward the top portion of the housing 3. The tapered engagements 13, 19 disposed on the wiper member 4, the backing member 5, and the housing 3 radially urges the wiper member 4 towards the moving plunger 10 at all times. The first filter member 8 shrouds the ports 9 of the adapter 2, preventing large wellbore debris particles from entering the operating region 18 of the pump 20. The second filter member 7 incorporates the radially extending bristles that bear against the tubing string 12 wall, preventing falling wellbore debris particles from entering the area adjacent to the first filter member 8.

Figure 2A:
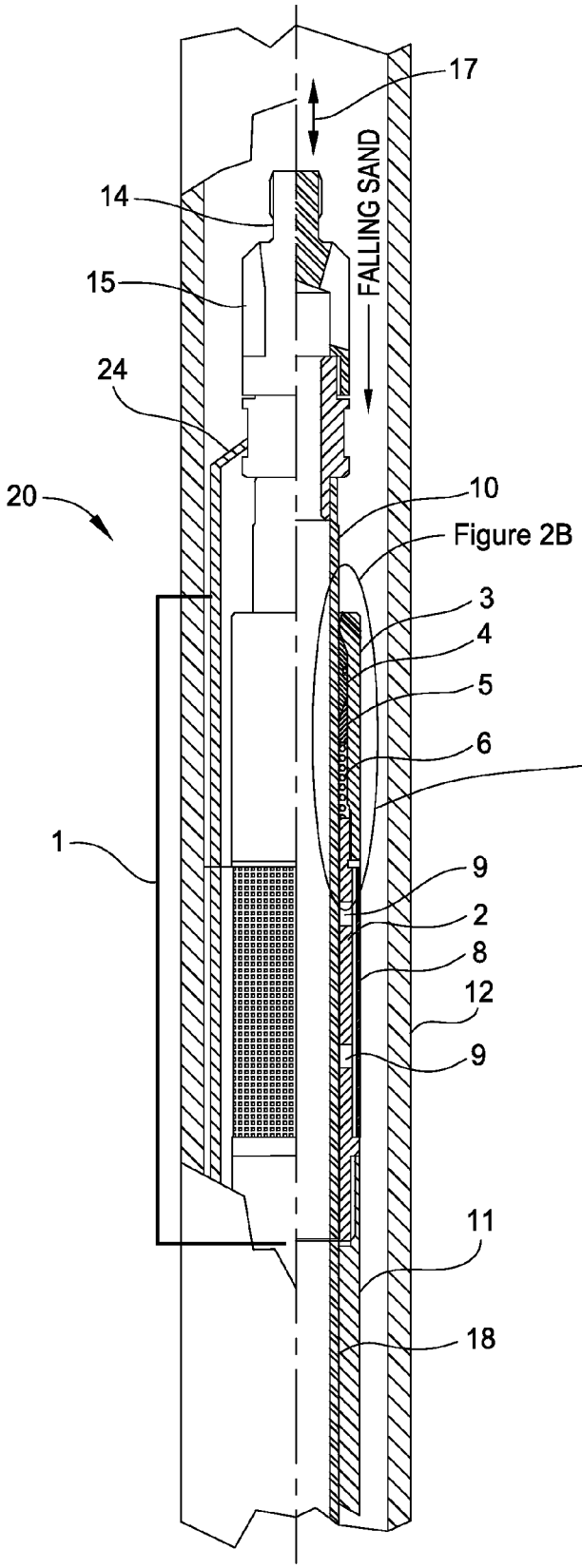
FIG. 2A illustrates a partial sectional view of the wiper assembly for a pump, according to one embodiment.
Figure 2B:
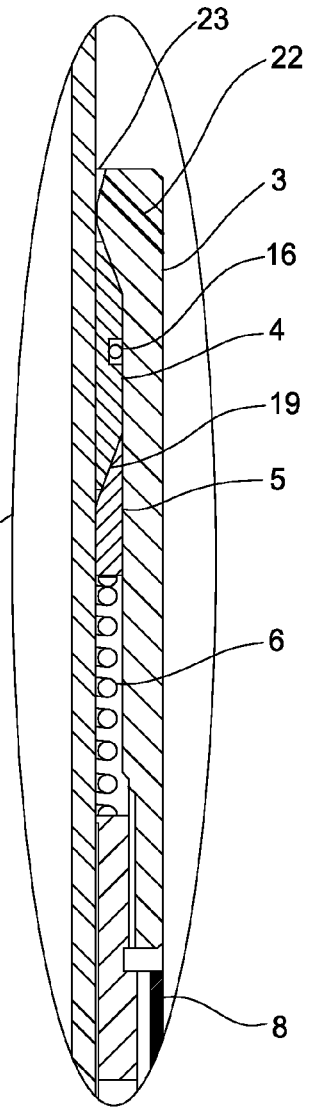
FIG. 2B illustrates an enlarged view of a section of the wiper assembly, according to one embodiment.

FIGS. 2A and 2B illustrate additional embodiments that may be part of or used with (or as an alternative to) the wiper assembly 1 as described herein.

As illustrated in FIG. 2A, a shroud member 24 may be coupled to the plunger 10 or other work string connections and may extend down to an area below the upper end of the barrel 11 to prevent debris from entering into the operating region of the pump 20. In one embodiment, the shroud member 24 may be a solid member, a screen member, or other filter type member. The shroud member 24 is only partially shown in FIG. 2A, but may extend around the entire circumference of the plunger 10 and the barrel 11. In one embodiment, the lower end of the shroud member 24 may engage the outer surface of the barrel 11, and may travel the same length as the stroke of the plunger 10 relative to the barrel 11. In one embodiment, the lower end of the shroud member 24 may not engage the outer surface of the barrel 11, and may travel the same length as the stroke of the plunger 10 relative to the barrel 11. In one embodiment, the shroud member 24 may be coupled to the housing 3 and may extend down a sufficient distance to prevent falling wellbore debris from flowing into the ports 9 of the adapter 2. In one embodiment, the shroud member 24 may be coupled to the adapter 2 and may extend down a sufficient distance to prevent falling wellbore debris from flowing into the ports 9 of the adapter 2.

As illustrated in FIG. 2B, one or more ports 22 may be disposed through the housing 3 (and/or barrel 11) adjacent an open upper end 23. The ports 22 may be angled and may be in communication with the bore of the housing 3 above the wiper member 4. The ports 22 may be configured to prevent build up of wellbore debris in the open upper end 23 of the housing 3 above the wiper member 4. In particular, the ports 22 allow debris or fluid entering into the upper end 23 of the housing 3 flow out of the housing 3.

While the foregoing is directed to embodiments of the invention, other and further embodiments of the invention may be devised without departing from the basic scope thereof, and the scope thereof is determined by the claims that follow.

The invention claimed is:

1. A wiper assembly for a pump having an operating member, comprising:
- a housing for receiving the operating member;
- a wiper member disposed in the housing and forced into engagement with the operating member to prevent debris from entering into an operating region of the pump;
- a first biasing member configured to bias a backing member into engagement with a first tapered surface of the wiper member and force a second tapered surface of the wiper member into engagement with a tapered surface of the housing to thereby force the wiper member radially inward into engagement with the operating member; and
- a second biasing member disposed between the wiper member and the housing and configured to force the wiper member into engagement with the operating member.

2. The assembly of claim 1, wherein the first biasing member biases a tapered surface of the backing member into engagement with the first tapered surface of the wiper member to thereby force the wiper member radially inward into engagement with the operating member.

3. The assembly of claim 1, wherein the first and second biasing members includes at least one of a spring, an o-ring, and a seal.

4. The assembly of claim 1, further comprising an adapter coupled to the housing below the wiper member and having one or more ports, and wherein the operating member is movably disposed within the housing and the adapter.

5. The assembly of claim 4, further comprising a first filter member coupled to the adapter for filtering fluid flow through the one or more ports.

6. The assembly of claim 5, further comprising a second filter member disposed above the first filter member for filtering fluid flow into an area adjacent to the first filter member.

7. A pump assembly, comprising:
- a pump having an operating member axially movable within a housing;
- a wiper assembly having a wiper member forced into engagement with the operating member to prevent debris from entering into the housing;
- a first biasing member configured to bias a backing member into engagement with a first tapered surface of the wiper member and force a second tapered surface of the wiper member into engagement with a tapered surface of the housing to thereby force the wiper member radially inward into engagement with the operating member; and
- a second biasing member disposed between the wiper member and the housing and configured to force the wiper member into engagement with the operating member.

8. The assembly of claim 7, wherein the housing is securable in a wellbore, and wherein the operating member is movable using a rod or tubing string extending from a surface of the wellbore.

9. The assembly of claim 8, wherein the operating member includes a bore and one or more openings for communicating fluid to the surface of the wellbore.

10. The assembly of claim 7, further comprising an adapter coupled to the housing and having one or more ports for directing fluid flow into an area surrounding the wiper assembly.

11. The assembly of claim 10, further comprising a first filter member for filtering fluid flow into the ports.

12. The assembly of claim 11, further comprising a second filter member disposed above the first filter member for filtering fluid flow into an area adjacent to the first filter member.

13. The assembly of claim 12, wherein the second filtering member includes a plurality of radially extending members for engagement with a surrounding wellbore wall.

14. The assembly of claim 7, wherein the wiper member is self-energized into engagement with the operating member.

15. The assembly of claim 7, further comprising a shroud member to prevent debris from entering into at least one of the pump and the wiper assembly.

16. The assembly of claim 7, wherein the housing includes one or more angled ports adjacent an open upper end of the housing.

17. A wiper assembly for a sucker rod pump having a reciprocating operating member, comprising:

a stationary housing having a tapered surface, the stationary housing configured to receive the reciprocating operating member;

a wiper member having a first tapered surface and a second tapered surface, wherein the wiper member is disposed in the stationary housing and configured to engage the reciprocating operating member;

a backing member having a tapered surface that engages the first tapered surface of the wiper member;

a first biasing member configured to force the tapered surface of the backing member against the first tapered surface of the wiper member and to force the second tapered surface of the wiper member against the tapered surface of the stationary housing such that the wiper member is forced radially inward into engagement with the reciprocating operating member; and a second biasing member disposed within a recess formed on an outer diameter of the wiper member between the wiper member and the housing and configured to force the wiper member radially inward into engagement with the reciprocating operating member.

* * * * *